US006345413B1

(12) United States Patent
Fletcher et al.

(10) Patent No.: US 6,345,413 B1
(45) Date of Patent: Feb. 12, 2002

(54) DOORSTOP DEVICE AND METHOD OF USE

(76) Inventors: Alan Fletcher, 856 Quail St., Ojai, CA (US) 93023; Tyson C. Hardman, 375 Monte Via, Oakview, CA (US) 93022

( * ) Notice: Subject to any disclaimer, the term of this patent is extended or adjusted under 35 U.S.C. 154(b) by 0 days.

(21) Appl. No.: 09/519,101

(22) Filed: Mar. 6, 2000

Related U.S. Application Data

(60) Provisional application No. 60/121,511, filed on Feb. 23, 1999.

(51) Int. Cl.[7] ..... E05F 5/02

(52) U.S. Cl. ..... 16/82; 16/374; 292/289; 292/343

(58) Field of Search ..... 16/82, 83, 85, 16/86 R, 86 A, DIG. 6, 371, 374, 375, 376; 292/280, 288, 289, 339, 342, 343, DIG. 15; 49/460, 462; D8/402

(56) References Cited

U.S. PATENT DOCUMENTS 2,691,793 A * 10/1954 Jacobs ..... 16/19
3,325,854 A * 6/1967 Steigerwald ..... 16/374
3,602,942 A * 9/1971 Neff, Sr. ..... 16/374
3,620,483 A * 11/1971 Weinberger ..... 16/86 A
3,758,141 A * 9/1973 Weinberger ..... 16/82
3,913,171 A * 10/1975 Reid ..... 16/82
D333,424 S * 2/1993 Kramer ..... 16/86 R
5,227,217 A * 7/1993 Roberts et al. ..... 49/462
5,265,922 A * 11/1993 Falcone ..... 16/375
D379,299 S * 5/1997 Fitzgibbons ..... 16/82
5,661,875 A * 9/1997 Overcash et al. ..... 16/82
5,675,865 A * 10/1997 Van der Steur ..... 16/82

FOREIGN PATENT DOCUMENTS

DE 4320558 A1 * 12/1994
GB 2258270 A * 2/1993

* cited by examiner

*Primary Examiner*—Chuck Y. Mah
(74) *Attorney, Agent, or Firm*—Angenehm Law Firm; N. Paul Friederichs; William Flynn

(57) ABSTRACT

A doorstop including a doorjamb engaging portion, the doorjamb engaging portion having a wall portion, the wall portion having an inset portion, the wall portion having a padded portion; a door engaging portion, the door engaging portion having a stair-step edge and an opposing side, the stair-step edge having a plurality of rises and a plurality of runs, the opposing parallel side and plurality of rises form an expanse, the expanse ranging from one to two inches; and a movement control portion, the movement control portion being homogenous with the door jamb engaging portion and the door engaging portion.

11 Claims, 2 Drawing Sheets

DOORSTOP DEVICE AND METHOD OF USE

This invention relates to doorstops and is a continuation of U.S. Provisional Patent Application No. 60/121,511 filed Feb. 23, 1999.

FIELD OF THE INVENTION

The present invention more particularly relates to portable doorstops that can be placed between a door and a doorjamb, whereby the door remains open.

BACKGROUND

People use and have used different mechanisms to prop doors open. Some doorstops are permanently attached to floors or walls. Other doorstops are portable. One portable doorstop is the commonly known wedge shaped doorstop. Another portable doorstop is shown in Payette in U.S. Pat. No. 5,547,238, issued Aug. 20, 1996. These portable doorstops will be discussed below.

The wedge shaped doorstop has a flat surface that is placed on the floor and an inclined surface that is placed against the bottom surface of a door. The wedge shaped doorstop is generally placed at the portion of the door that is not hinged to the doorjamb. The design, while simple, has inherent problems. One problem with the wedge shaped doorstop is that it may easily be overturned in which condition it will no longer hold the door open.. People or objects unintentionally push, pull and bump the doorstop causing it to overturn or be pushed out of position. Another problem with the wedge shaped doorstop is that this doorstop must create enough friction between the floor and itself to prevent the doorstop from slipping out of position on its own. As the doorstop, usually made of rubber, ages, it loses its ability to generate the appropriate amount of friction and the stop, even in good repair, does not generate sufficient friction on all floors. Further, the doorstop may become disfunctional when being used with heavy doors or doors with a strong closer. When the doorstop is out of its proper position, the door will shut.

The doorstop described by Payette is a circular disk. The upper portion of the circular disk is conical in shape. This doorstop is placed towards the open portion of the door (i.e., away from the hinges on the door). The conical shape of this doorstop allows for the possibility that the door may be bumped out of position. The conical shape also allows for the possibility that if the doorstop is not placed properly near the door, the door will slide down the incline and close. Payette's stop has other problems similar to those outlined above with regard to the wedge shaped door stop.

Both the wedge-shaped doorstop and Payette's doorstop are placed generally near the unhinged portion of the door and are not as well secured between the elements found in the vacinity of a door. The choice of interactive componants, e.g., door, floor and stop, lead to many of the problems inherent in the design. When the stop is not functioning properly, the door closes to the dissatisfaction of the user.

What is needed is a door stop which does not unintentionally become easily dislodged, bumped, pushed or pulled out of position. The stop should work regardless of the flooring about the door and should work with all doors.

SUMMARY

The present invention is a doorstop designed to be placed in the hinged area between a door and associated jam. The door stop includes a door jamb engaging portion, a door engaging portion and a movement control portion. These are preferably homogenous portions of a single piece.

The door jamb engaging portion may be a relatively flat edge that braces against the door jamb. Preferably, it has an inset designed to fit about the wood strip found on the interior face of a doorjamb such that the doorjamb engaging portion lies flat against the interior face of the door jamb. Padding may be placed on all or a portion of the door engaging portion if desired.

The door engaging portion defines an expanse in which the hinged edge of the door is captured. An edge defining the expense preferably has a stair-step shape allowing the stop to be used with different sized doors. The opposing edge may be stair stepped, although it is preferably flat and the distance between the two edges may range from one to two inches or more if desired.

The movement control portion provides bracing between the door jamb engaging portion and the door engaging portion, keeping the two portions apart at a predetermined distance. The movement control portion may be homogenous with the door jamb engaging portion and the door engaging portion.

The door stop is placed between a door and associated door jamb. The door is fitted into an expanse defined in the door engaging portion. The door jamb engaging portion is rested against the door jamb. Material, such as the movement control portion, maintains the distance between the door engaging portion and the doorjamb engaging portion. With the door stop in place, the door is released, trapping the doorstop in the appropriate location to hold the door open.

In accordance with the present invention, a doorstop device comprises a door engaging mechanism and a doorjamb engaging mechanism.

The present invention is placed between the door and the doorjamb.

The present invention fits in between the door and the doorjamb by mechanical structure.

DRAWING FIGURES

DETAILED DESCRIPTION

Figure 1:
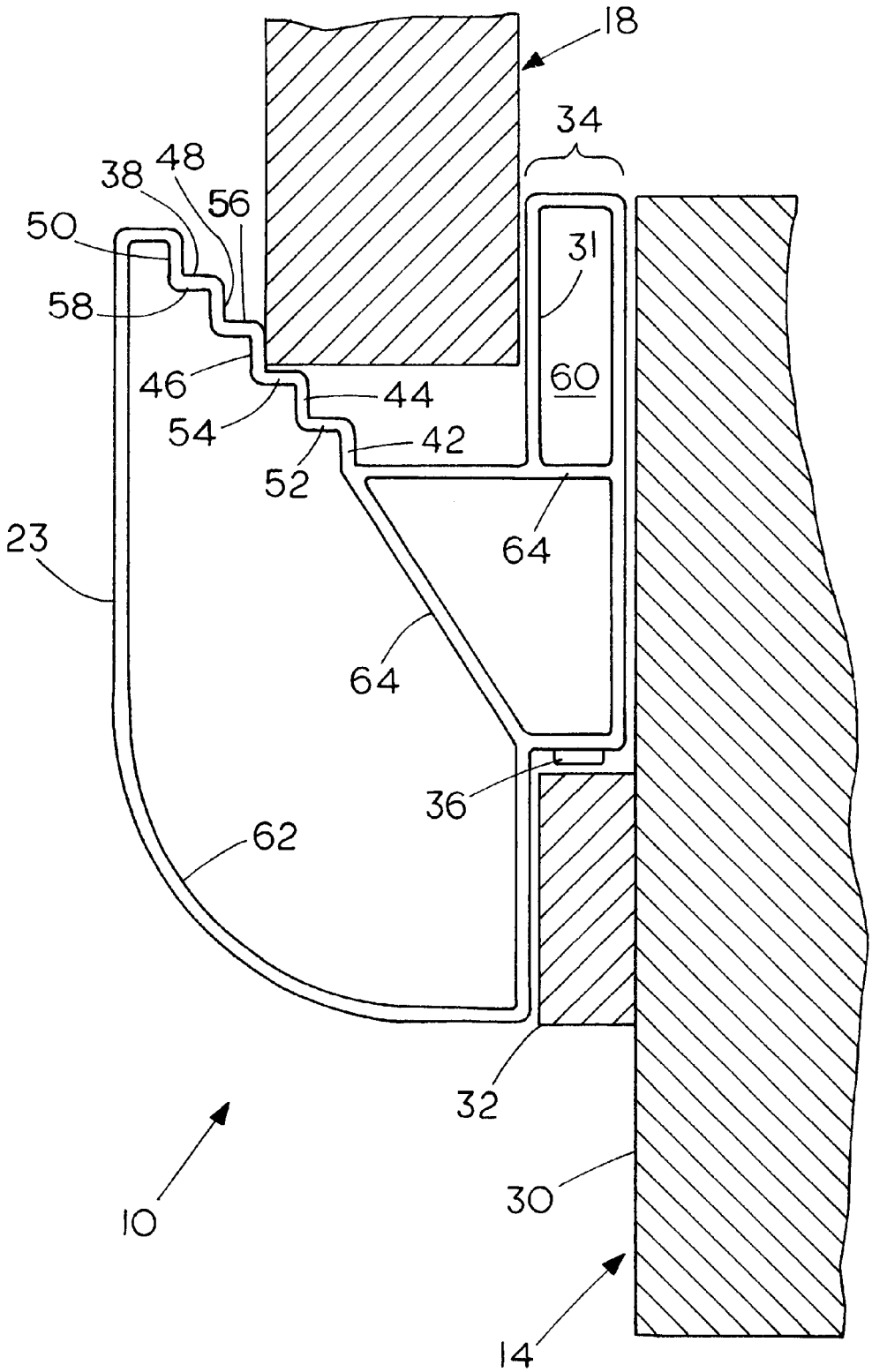
FIG. 1 is a cutaway top view of the present invention.
Figure 4:
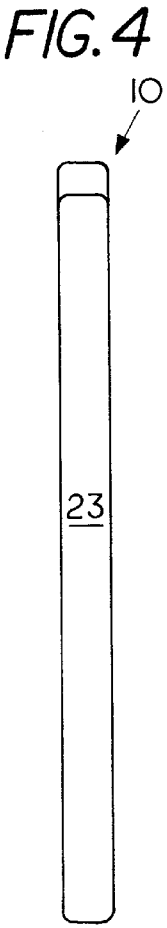
FIG. 4 is a side view (of the edge portion) of the present invention.
Figure 3:
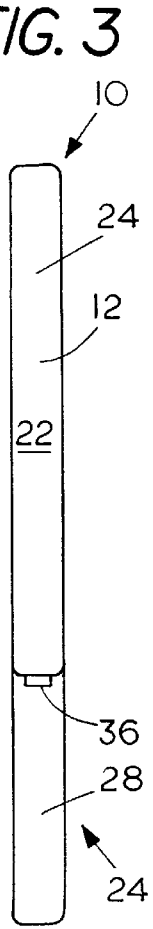
FIG. 3 is a side view (of the door engaging mechanism) of the present invention.
Figure 2:
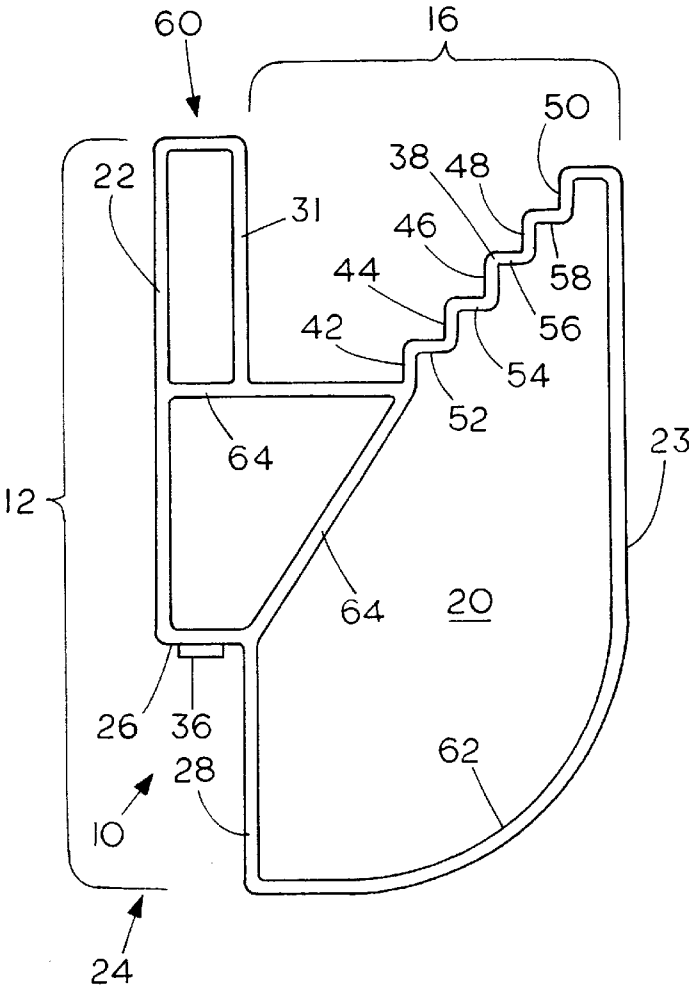
FIG. 2 is a top view of the present invention.

The present invention 10 props doors and like objects in an open position. FIG. 1 shows the invention 10 installed between a doorjamb 14 and a door 18 with the doorjamb 14 and door 18 shown in cross-section. FIG. 2 shows the reverse side of the invention 10 to that shown in FIG. 1. FIG. 3 shows the edge of wall portion 22. FIG. 4 shows the edge portion 23. The present invention 10 includes mechanism 12 for engaging the door jamb 14, mechanism 16 for engaging the door 18 and mechanism 20 for controlling movement between door jamb engaging mechanism 12 and door engaging mechanism 16. The invention 10 may be formed of any material of suitable strength and rigidity for the environment shown, including polymers, elastomers, wood, metal, ceramic, glass, other relatively rigid materials, and combinations thereof. Padding on particular points may also be used.

The mechanism 12 for engaging a doorjamb 14 may be any device or method capable of providing selective or permanent engagement with the doorjamb 14. Fasteners known in the art of fastening, including screws, nails, glues or integral attachment may be used. However, the present invention 10 preferably envisions a selective engagement between the mechanism 12 and the doorjamb 14 such as that provided by wall portion 22.

Wall portion 22 preferably is sized and shaped to form fit against at least a portion of the doorjamb 14. Wall portion 22 may be of any configuration adequate to allow this contact, but preferably contains an inset portion 24 with edges 26, 28 to allow optimal contact with the door jamb 14, including the inside wall 30 of the jamb 14 and strip 32 which may be formed of wood, metal, polymer or other. The invention 10 in this embodiment is intended to be pressure held between the gap 34 between the door 18 and doorjamb 14, although selective adhesives, other selective fasteners and/or a tacky outer coating applied to the wall 22 may also be used, especially if the door 18 is not connected to a closing arm (not shown). The whole wall 22 or just inset portion edge 26 may include a padding mechanism 36. Padding mechanism 36 may be separately attached via glue or other adhesive means, or may be integral to inset portion edge 26. The mechanism 16 for engaging a door 18 is preferably constructed using a stair-step shape edge 38 allowing for use on a plurality of door widths. Each stair-step rise 42, 44, 46, 48, 50 is of sufficient height to allow contact with the door 18 without allowing slippage to the next level (e.g., 42 to 44 when the door is moved to a position of being opened further or 44 to 42 when the door is moved toward a more closed position, etc.). Height of rise 42, 44, 46, 48, 50 may be between ⅛ inch and 2 inches, but is preferably ¼ inch in height. Each stair-step run portion 52, 54, 56, 58 is of sufficient depth to allow the door 18 to remain seated solidly. Depth of run portions 52, 54, 56, 58 may be between ⅛ inch and 2 inches, but is preferably ¼ inch in depth. Each stair-step rise 42, 44, 46, 48, 50 in conjunction with the opposing parallel side 31 forms an expanse that may range in length from ¼ inch to 5 inches, but are preferably within the range from 1 inch to 2 inches in length. The distance between each rise portion 42, 44, 46, 48 and 50 and opposing parallel side 31 is preferably consecutively larger with each rise portion as shown. These distances preferably match the common widths of various doors 18. While a stair-step shape edge 38 is the preferred embodiment, any configuration sufficiently shaped to control movement of a door 18 may be used without departing from the scope of the present invention 10, including an adjustable clamping mechanism or simply use of projection 60 in the absence of a stair step shaped edge 38. Mechanism 20 controls movement between doorjamb engaging mechanism 12 and door engaging mechanism 16. Mechanism 20 may be of any size sufficient to allow the present invention 10 to remain in place between the door 18 and the door jamb 14 while allowing the door 18 to remain in a primarily open position. Mechanism 20 includes all area between all portions of the outer wall 62. Outer wall 62 may be of any configuration adequate to provide the necessary strength to support the expected physical pressure between the doorjamb 14 and the door 18. Mechanism 20 may, but is not required to, include support ridges 64.

In operation, the user opens the door 18 and inserts the invention 10 such that projection 60 extends into the gap 34 defined between the door 18 and jamb 14. The wall portion 22 and edge 28 are oriented to squarely engage inside wall 30 of the doorjamb 14 and the strip 32 respectively. Padding mechanism 36 may engage the strip 32 or not. The door 18 is positioned between the wall 31 of projection 60 and rise portion 42, 44, 46, 48, or 50 and is brought to rest against run portion 52, 54, 56, or 58. FIG. 1 shows the door 18 position between wall 31 in rise portion 46 and seated against run portion 54. Doors 18 of differing widths would engage different rise and run portions. Once installed the doorstop 10 prevents significant movement of the door 18 relative to the jamb 14 and thereby precludes closing of the door 18.

Although the present invention has been described with reference to preferred embodiments, workers skilled in the art will recognize changes may be made in form and detail without departing from the spirit and scope of the invention.

We claim:

1. A doorstop device comprising:

means for engaging a door jamb;

means for engaging a door, the means for engaging the door having a stair-step edge and an opposing side; and means for controlling movement between the means for engaging the door jamb and the means for engaging the door, the means for controlling movement being homogeneous with the means for engaging the door jamb and the means for engaging the door.

2. The doorstop device of claim 1 wherein the means for engaging a doorjamb further comprises:

an inset portion with at least two walls.

3. The doorstop device of claim 2 further including:

padding, the padding being joined to at least one wall of the inset portion.

4. The doorstop device of claim 2 wherein:

the stair-step edge having a plurality of rises and a plurality of runs, the plurality of rises ranging from ⅛ inch to two inches and the plurality of runs ranging from ⅛ inch to two inches.

5. The doorstop device of claim 4 wherein:

the plurality of rises are ¼ inch and the plurality of runs are ¼ inch.

6. The doorstop device of claim 5 wherein:

the opposing side and plurality of rises form an expanse and the expanse ranges from ¼ inch to five inches.

7. The doorstop device of claim 6 wherein:

the expanse ranges from one to two inches.

8. A doorstop device comprising:

a doorjamb engaging portion, the doorjamb engaging portion having a wall portion, the wall portion having an inset portion, the wall portion having a padded portion;

a door engaging portion, the door engaging portion having a stair-step edge and an opposing side, the stair-step edge having a plurality of rises and a plurality of runs, and plurality of rises form an expanse, the expanse ranging from one to two inches; and a movement control portion, the movement control portion being homogenous with the doorjamb engaging portion and the door engaging portion.

9. A method of holding a door open comprising the steps of:

opening a door, inserting a doorstop between the door and an interior surface of a door jamb having hinges; and releasing the door such that the door stop maintains the door in an open position.

10. The method of claim 9 wherein the doorstop has a stair-stepped wall designed to engage doors of different thicknesses.

11. The method of claim 9 wherein the doorstop braces against a strip mounted on the interior surface of the door jam.

* * * * *